United States Patent [19]

Itoh et al.

[11] Patent Number: 4,487,036

[45] Date of Patent: Dec. 11, 1984

[54] HERMETICALLY CIRCULATING, ABSORPTION TYPE REFRIGERATOR

[75] Inventors: Masahiko Itoh, Hitachiota; Heihatiro Midorikawa; Akira Minato, both of Hitachi; Kenzi Machizawa, Ibaraki, all of Japan

[73] Assignee: Hitachi, Ltd., Tokyo, Japan

[21] Appl. No.: 532,109

[22] Filed: Sep. 14, 1983

[30] Foreign Application Priority Data

Sep. 22, 1982 [JP] Japan ..... 57-163929

[51] Int. Cl.[3] ..... F25B 43/00

[52] U.S. Cl. ..... 62/474; 62/476; 62/497

[58] Field of Search ..... 62/474, 476, 497

[56] References Cited

U.S. PATENT DOCUMENTS 2,802,344 8/1957 Witherell ..... 62/497 X 3,407,625 10/1968 McDonald ..... 62/497 X 4,272,965 6/1981 Thoms ..... 62/476 X 4,290,273 9/1981 Meckler ..... 62/476 X 4,311,024 1/1982 Itoh et al. ..... 62/474

*Primary Examiner*—Lloyd L. King

*Attorney, Agent, or Firm*—Antonelli, Terry & Wands

[57] ABSTRACT

In a hermetically circulating absorption type refrigerator including a regenerator, a condenser, an evaporator, an absorber and a heat exchanger, the regenerator has an absorbing solution heating tube flux provided between tube plates. The tube plates are encased within a shell of the regenerator. Non-soluble electrodes are arranged between each of the tube plates and the shell. Then, an anti-corrosive current is made to flow through at least one of an end portion of the heating tube, the tube plates and the shell to thereby enhance the anti-corrosion effect together with an anti-corrosive agent or inhibitor.

5 Claims, 2 Drawing Figures

HERMETICALLY CIRCULATING, ABSORPTION TYPE REFRIGERATOR

BACKGROUND OF THE INVENTION

The present invention relates to a hermetically circulating, absorption type refrigerator and more particularly, to a hermetically circulating, absorption type refrigerator (hereinafter simply referred to as a refrigerator) having an excellent anti-corrosive effect and a high reliability.

In such a refrigerator, since an aqueous concentrated lithium bromide solution having a high corrosive effect is used as an absorbing solution, a problem of corrosion acting on structural components thereof is raised. To cope with this, a conventional method in which various inhibitors (anti-corrosive agents) are contained in an absorbing solution has been carried out. To enhance an efficiency of the refrigerator, the operational temperature thereof has, recently, been elevated, and it will exceed a temperature of 200° C. in near future. Accordingly, an environment of corrosion becomes considerably severe, and it is difficult to suppress the corrosion with the conventionally used inhibitors.

On the other hand, in an ordinary small size boiler having a simple construction, there is an example in which an electric anti-corrosion method is used. However, since the refrigerator has a complicated inner structure and is formed of various kinds of metal materials such as carbon steel, copper, cupronickel, brass and the like, it is difficult to set anti-corrosive potentials. For this or other reasons, there have been no studies at all as to a corrosion suppression solely or independently in accordance with the electric anti-corrosion method. Also, any attempt has not been made to use simultaneously the effects of the inhibitors and the electric anti-corrosion method for the following reasons.

(1) In the case of using the two effects, the inhibitor is, in general, an inorganic material of oxidizer type, which forms a dense film comprised mainly of $Fe_3O_4$ to thereby suppress corrosion. Since an electric resistance of the iron oxide is much higher than that of iron, to make a anti-corrosive current, which is required for the electric anti-corrosion, flow through the film, a voltage higher than usual must be applied between electrodes and structural components of the refrigerator. However, the iron oxide film is continuously and repeatedly subjected to a destruction and a reproduction or repair with the inhibitor, during operation of the refrigerator. When the iron oxide film is destroyed, a current corresponding to a higher voltage is concentrated thereon, as a result of which the destroyed portion is excessively anti-corrosive to generate a hydrogen gas in accordance with a conventional cathode anti-corrosion method. The interior of the refrigerator is kept in a hermetical and vacuum system. Therefore, generation and accumulation of the hydrogen gas cause an elevation of an inner pressure, resulting in remarkable reduction in ability of the refrigerator.

(2) Furthermore, in case that the excessive anti-corrosion state is caused as described above, a pH value of the absorbing solution will be varied in accordance with the effect of $OH^-$ ion generated at the anode as the hydrogen gas is generated.

SUMMARY OF THE INVENTION

In view of the above noted defects, the present inventors have made various studies and have found an unexpected result in which at a particular portion of a refrigerator, the above-described adverse effect is not obtained in accordance with the electric anti-corrosion method and a good anti-corrosive effect is obtained. The present inventors thus make the present invention.

Accordingly, an object of the present invention is to provide a hermetically circulating, absorption type refrigerator in which an anti-corrosive process is carried out to bring about a satisfactory effect.

According to the invention, in some parts of the refrigerator, where a relatively low temperature is kept, an anti-corrosion method is carried out with an inhibitor as used in the conventional manner. On the other hand, in a high temperature regenerator which is kept at the highest temperature in operation of the refrigerator, in case of a double effect apparatus, a concentration of lithium bromide solution is in a range of about 62 to 64% and a temperature thereof is in a range of about 150° to 160° C. and in case of a triple effect apparatus, a concentration is about 65% and a temperature is about 200° C. Therefore, corrosiveness at the parts is very strong. To cope with this, the corrosion in the regenerator is prevented by making corrosive currents flow out of an outside electric source while a non-soluble electrode, more preferably, a cathode is provided in the regenerator which is kept at a particularly high temperature and a constituent member of the regenerator is used as the other electrode, more preferably, an anode.

DETAILED DESCRIPTION OF THE PREFERRED EMBODIMENTS

Figure 1:
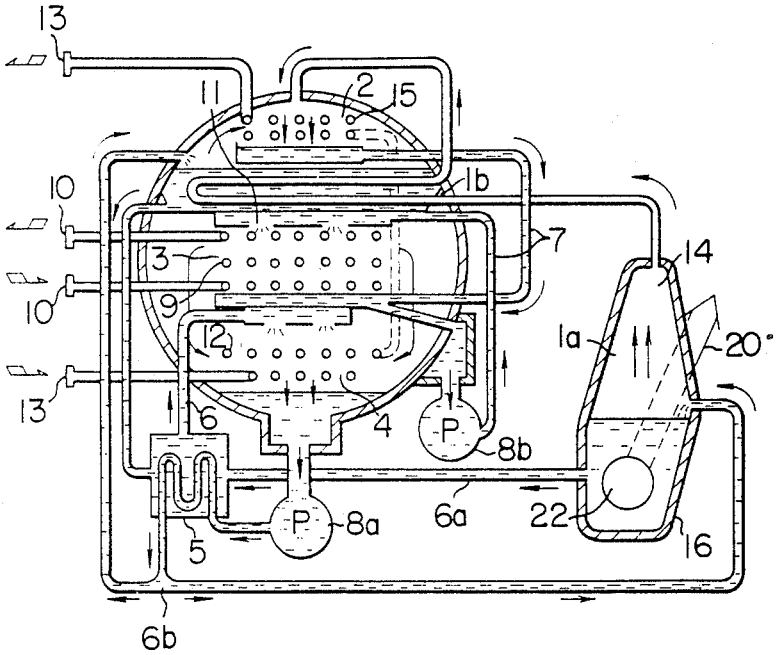
FIG. 1 is a systematic view showing a principle of a double effect absorption type refrigerator as one embodiment of the invention.

The present invention will now be described with reference to the accompanying drawings. FIG. 1 shows a principle of the double effect absorption type refrigerator according to the invention. The double effect absorption refrigerator is comprised of regenerators 1*a* and 1*b*, a condenser 2, an evaporator 3, an absorber 4, pump means 8 for circulating absorbing solutions 6, 6*a* and 6*b* and refrigerant 7 among these structural components and a heat exchanger 5. Each component will operate as follows.

(A) EVAPORATOR 3

A cool water 10 is supplied into interiors of an evaporator tube bundle 9 of the evaporator 3 whereas a refrigerant 7 supplied from a refrigerant pump 8*b* is sprayed to the outside of the tube bundle through spray nozzles 11 to thereby remove heat out of the cool water by its evaporation latent heat.

(B) ABSORBER 4

An aqueous lithium bromide solution has a vapor pressure much lower than that of water kept at the same temperature and enables to absorb water vapor generated at a considerably low temperature. In the absorber 4, a refrigerant vapor generated in the evaporator 3 is absorbed into the aqueous lithium bromide solution (absorbing solution) 6 sprayed onto the outer surfaces of cooling tubes 12 of the absorber 4. Absorption heat generated at this time is cooled by a cooling water 13 passing through the tubes.

(C) REGENERATORS 1*a* and 1*b*

A diluted absorbing solution 6*b* which absorbs the refrigerant at the absorber 4 to reduce its concentration has a weak absorbing ability. Therefore, a part of the absorbing solution 6*b* is fed to a high temperature regenerator 1*a* by a solution circulating pump 8*a* and is heated thereat by a gas burner or the like to thereby evaporate and separate a high temperature refrigerant vapor 14 therefrom. As a result, the solution is condensed and returned back to the absorber 4. The other part of the diluted absorbing solution is fed to a low temperature regenerator 1*b* by the solution circulating pump 8*a* and is heated and condensed by the high temperature refrigerant vapor 14. Subsequently, the solution 6*b* is mixed with the absorbing solution 6*a* fed out of the high temperature regenerator in the heat exchanger 5 and is returned back to the absorber 4.

(D) CONDENSER 2

The high temperature refrigerant vapor 14 separated from the solution at the high temperature regenerator 1*a* discharges or radiates a part of its heat and is introduced into the condenser 2 where it is cooled and condensed to be liquefied by the cooling water 13 flowing through interiors of cooling pipes 15 to become refrigerant 7 and to be returned back to the evaporator 3.

(E) HEAT EXCHANGER 5

The diluted solution 6*b* kept at a low temperature which flows toward the high temperature regenerator 1*a* and the low temperature regenerator 1*b* from the absorber 4 is preheated by the condensed solution 6*a* which flows toward the absorber 4 from the low temperature regenerator 1*b*, to enhance its heat or thermal efficiency.

(F) PUMPS 8*a* and 8*b*

The solution circulating pump 8*a* serves to circulate the aqueous lithium bromide solution (absorbing solution) and the refrigerant pump 8*b* serves to circulate the refrigerant (water).

Figure 2:
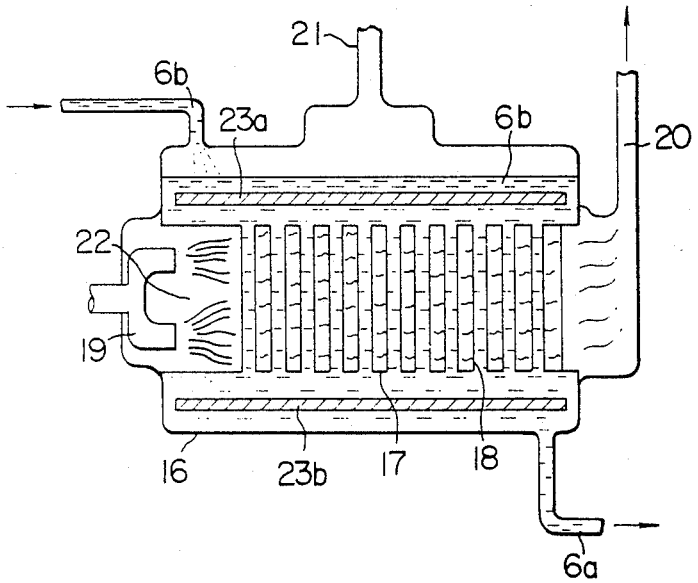
FIG. 2 is a cross-sectional view of the regenerator shown in FIG. 1.

FIG. 2 shows a cross-sectional view of the high temperature regenerator provided with an electric anti-corrosive means.

The high temperature regenerator is composed of a shell 16, tube plates 17, heating tubes 18, a burner 19, an exhaust gas discharge funnel 20 and a refrigerant vapor pipe 21. The absorbing solution 6*b* passes through the interiors partitioned apart from a combustion chamber 22 by the tube plates 17 and the heating tubes 18 disposed in the shell 16 and is heated and condensed in the heating tubes 18 to be circulated through the interior of the high temperature regenerator in accordance with the temperature difference. A burnt exhausted gas is discharged from the funnel 20 to the outside of the apparatus. The refrigerant vapor separated from the absorbing solution heated is introduced into the low temperature regenerator through the refrigerant vapor pipe 21.

In this apparatus, the inner surfaces of the shell 16, the tube plates 17 and the heating tubes 18 are subjected to corrosion. However, the electric anti-corrosion is carried out thereon by applying anti-corrosive currents to the shell 16, the tube plates 17 and the heating tubes 18 while using non-soluble electrodes 23*a* and 23*b* which are each made of meshes of palladium coated titanium wires. In the case where the electrodes 23*a* and 23*b* are used as cathodes by applying a negative voltage to the non-soluble electrodes, the shell 16, the tube plates 17 and the heating tubes 18 are subjected to an anode electric anti-corrosion effect whereas in the case where the electrodes 23*a* and 23*b* are used as anodes by applying a positive voltage to the non-soluble electrodes, the shell 16, the tube plates 17 and the heating tubes 18 are subjected to an cathode electric anti-corrosion effect. As the non-soluble electrodes 23*a* and 23*b*, it is not desirable to use a planar structure which would prevent convection of the absorbing solution and is preferable to use a mesh structure.

As a result of the inventors' studies, it was found that a carbon steel constituting a part of the high temperature regenerator showed a passive state in the aqueous concentrated lithium bromide solution kept at a high temperature. In view of this fact, it was considered that a method in which a voltage was applied thereto from the outside in order to keep its passive potential, that is, the anode anti-corrosion method was available. Actually, the use of both the method and the inhibitor provided a good result. A value of optimum anti-corrosion potential depended on the kinds of the inhibitors used as described in the Table 1 and in addition was somewhat varied in a higher or lower direction in accordance with concentration and temperature of the solution.

TABLE 1

| Absorbing solution concentration: LiBr 63%, LiOH 0.2%<br>temperature: 160° C. | |
|---|---|
| Inhibitor | Optimum anti-corrosion Potential (mV) |
| $LiNO_3$ | −620 |
| $LiCrO_4$ | −580 |
| $Na_2MoO_4$ | −550 |
| $Na_2MoO_4$ + BTA | −600 |
| $Na_2B_4O_7$ + BTA | −550 |

Note:
BTA represents benzotriazole.

Accordingly, the values listed in the above Table 1 should be used for reference but should be disregarded in some particular cases. The values should be determined on the basis of the polarization curve measurement of anode conducted under predetermined conditoins.

Also, it was found that a cathode electric anti-corrosive method which had been considered undesirable was available. By changing a potential value of a carbon steel in a direction lower by 100 to 200 mV than a natural potential in the absorbing solution, an anti-corrosion effect somewhat lower than that obtained by the anode electric anti-corrosive method was confirmed. It was preferable to use this method together with the effect of inhibitor. Table 2 shows natural potential values of solution. The concentrations and temperatures of the absorbing solution are the same as those indicated in Table 1. The natural potential values are also varied in accordance with a kind of inhibitor.

TABLE 2

| Inhibitors | Natural potential (mV) |
|---|---|
| $LiNO_3$ | −700 |
| $LiCrO_4$ | −760 |
| $Na_2MoO_4$ | −740 |
| $Na_2MoO_4$ + BTA | −770 |

TABLE 2-continued

| Inhibitors | Natural potential (mV) |
|---|---|
| $Na_2B_4O_7$ + BTA | −740 |

Since the potential is varied somewhat in a higher or lower direction in accordance with the temperature and concentration of the solution, the potential should be measured under necessary conditions, and the optimum anti-corrosive potential should be determined on the basis of the measurement.

Also in either of the electric anti-corrosion methods, the non-soluble electrodes made mainly of palladium coated titanium are preferably used as cathode or anode electrodes. The non-soluble electrodes made of zinc, aluminum or the like are not preferable since soluted ions such as $Zn^{2+}$ or $Al^{3+}$ would change its absorbing solution characteristics.

The Examples of the present invention will now be described.

EXAMPLE 1

As model tests, the experiments were conducted under the conditions similar to those in the high temperature regenerator of the triple effect absorption type refrigerator. A carbon steel was dipped in an absorbing solution into which was added 0.2% lithium chromate admixed with 0.2% lithium hydroxide and 65% lithium bromide concentration solution as the absorbing solution. $N_2$ gas was inspired into the absorbing solution and deaerated so that its temperature was elevated up to a temperature of 200° C. and was corroded for 200 hours. One side of the carbon steel test piece was electrically anti-corroded while a palladium coated titanium electrode was used as a cathode and the potential of the carbon steel was maintained at −580 mV by a DC constant voltage device. The other side of the test piece was dipped as it was. A corrosion of the carbon steel after 200 hours was 750 mg/dm$^2$ in the case of the inhibitor of lithium chromate solely whereas a corrosion was 56 mg/dm$^2$ in the case of additionally using the anode electric anti-corrosion method, which was one-tenth or less of the former case. In the case of using solely the lithium chromate inhibitor, a remarkable pitting corrosion was generated. On the other hand, in the case of using additionally the electric anti-corrosion method, there was almost no corrosion.

EXAMPLE 2

The same constituents of the solution and experimental conditions as in the foregoing Example 1 were used in the Example 2 except for the followings. In the Example 2, one side of a carbon steel test piece was subjected to a cathode electric anti-corrosion method so that it was connected as a palladium coated titanium electrode and the surface potentional of the carbon steel was kept at −900 mV. Also, the other side of the carbon steel was used as it was. The corrosion of the carbon steel after 200 hours was 750 mg/dm$^2$ in the case of using solely the lithium chromate inhibitor whereas it was 120 mm/dm$^2$ in case of using additionally the cathode anti-corrosion method, which was a good result.

EXAMPLE 3

The experiment was carried out in the same manner as in the Example 1. However, sodium molybodate was added by 0.2% as the inhibitor and the test piece was corroded at a temperature of 200° C. for 200 hours. The carbon steel test piece 1 was subjected to the anode electric anti-corrosion while the potential was maintained at −550 mV, the same test piece 2 was subjected to the cathode anti-corrosion while the potential was maintained at −860 mV, and the test piece 3 was dipped without any measure. As a result, the corrosion was 600 mg/dm$^2$ in the test piece 3 whereas it was 70 mg/dm$^2$ in the test piece 1 and it was 136 mg/dm$^2$ in the test piece 3.

EXAMPLE 4

The present invention was applied to the double effect absorption type refrigerator having a refrigerating capacity of 60 RT. First of all, an absorbing solution containing 0.5% by weight lithium nitrate as an inhibitor (a solution of lithium bromide and lithium hydroxide) was sealed in the double effect apparatus and were operated at a full load for 100 hours. When the amount of hydrogen gas generated at this time was measured, the generated rate was 1 ml/min. Subsequently, in the high temperature regenerator of the 60 RT double effect apparatus of the same tipe, 10 electrode rods (15 mm in diameter ×300 l) to which palladium was applied were used as cathodes and the wall of the high temperature regenerator was used as an anode while the surface potential was kept at −0.9 V in the high temperature regenerator wall by a DC stabilizing electric source. Under such a condition, a current was applied thereto. The apparatus was operated at the full load for 100 hours. The measured hydrogen generating rate was 0.05 to 0.2 ml/min, which was one-sixth or less of the case of using solely the inhibitor. The hydrogen gas is generated due to the corrosion of the carbon steel which is the constituent member of the apparatus. Therefore, the hydrogen generating rate of 1/6 or less means that the corrosion rate is 1/6 or less.

As has been apparent from the above, in the absorption type refrigerator, in addition to using the absorbing solution containing the inhibitor, the parts where the absorption solution temperature is kept high, that is, the high temperature regenerator is further subjected to the electric anti-corrosion method of the external electric source type so that respective parts of the refrigerator are subjected to the anti-corrosion effect in accordance with the respective corrosion conditions with a high efficiency. Accordingly, in accordance with the present invention, in case that the absorbing solution temperature reaches 200° C., a hole corrosion or the like is not caused and a small amount of hydrogen is generated. In addition, a refrigerator having a good corrosion proof property and an enhanced reliability may be provided with a long service life. Therefore, it is possible to develop the refrigerator up to triple and four stage effect apparatus with a high efficiency.

What is claimed is:

1. In a hermetically circulating, absorption type refrigerator including a regenerator, a condenser, an evaporator, an absorber and a heat exchanger, said refrigerator characterized in that said regenerator has an absorbing solution heating tube flux provided between two tube plates encased within a shell; non-soluble electrodes are disposed between each of said tube plates and said shell; and an anti-corrosive current is made to flow through at least one of an end portion of the heating tube of said heating tube flux, said tube plates and said shell.

2. The refrigerator of claim 1, in which said non-soluble electrodes are used as cathodes and said shell and said tube plates of said regenerator are used as anodes.

3. The refrigerator of claim 1, in which said non-soluble electrodes are used as anodes and said shell and said tube plates of said regenerator are used as cathodes.

4. The refrigerator of claim 2, in which said refrigerator is of a triple effect type.

5. The refrigerator of claim 3, in which said refrigerator is of a triple effect type.

* * * * *